US005895045A

United States Patent [19]

Vilar

[11] Patent Number: 5,895,045

[45] Date of Patent: Apr. 20, 1999

[54] MODULAR CARD CONSTRUCTION TOY

[75] Inventor: Guillermo M. Vilar, Cuernavaca, Mexico

[73] Assignee: Serigraph, Inc., West Bend, Wis.

[21] Appl. No.: 08/978,922

[22] Filed: Nov. 26, 1997

Related U.S. Application Data

[63] Continuation-in-part of application No. 08/863,856, May 27, 1997.

[30] Foreign Application Priority Data

Nov. 13, 1997 [MX] Mexico ..... 97358

[51] Int. Cl.[6] ..... A63H 33/08

[52] U.S. Cl. ..... 273/160; 446/115; 446/488

[58] Field of Search ..... 273/153 R, 156, 273/157 R, 160; 446/102, 104, 111, 112, 113, 115, 488

[56] References Cited

U.S. PATENT DOCUMENTS

| | | | |
|---|---|---|---|
| 1,890,269 | 12/1932 | Swanson | 446/115 |
| 2,057,942 | 10/1936 | Fay | 446/112 |
| 2,112,474 | 3/1938 | Warren . | |
| 2,454,307 | 11/1948 | Cooley . | |
| 2,558,591 | 6/1951 | Starck | 273/160 |
| 2,814,159 | 11/1957 | Green . | |
| 3,003,260 | 10/1961 | Bassetti . | |
| 3,120,078 | 2/1964 | Bessinger | 446/112 |
| 3,666,607 | 5/1972 | Weissman . | |
| 3,701,214 | 10/1972 | Sakamoto | 273/160 |
| 3,819,188 | 6/1974 | Freedman | 273/160 |
| 3,895,229 | 7/1975 | Strom . | |
| 3,924,376 | 12/1975 | Tsurumi | 446/115 |
| 3,991,511 | 11/1976 | McAllister et al. . | |
| 4,055,019 | 10/1977 | Harvey | 446/115 |
| 4,454,678 | 6/1984 | Duvivier . | |
| 4,606,732 | 8/1986 | Lyman . | |
| 4,731,041 | 3/1988 | Ziegler | 446/115 |
| 4,804,350 | 2/1989 | Chen . | |
| 5,022,885 | 6/1991 | Lyman . | |
| 5,281,185 | 1/1994 | Lee . | |

FOREIGN PATENT DOCUMENTS

| | | |
|---|---|---|
| 1128129 | 4/1958 | France . |
| 2324136 | 11/1974 | Germany . |
| 87329 | 9/1936 | Sweden . |
| 289615 | 5/1928 | United Kingdom . |
| 759940 | 10/1956 | United Kingdom . |
| 2145341 | 3/1985 | United Kingdom . |
| 2248582 | 4/1992 | United Kingdom . |

*Primary Examiner*—Steven Wong
*Attorney, Agent, or Firm*—Andrus, Sceales, Starke & Sawall

[57] ABSTRACT

A construction toy includes a plurality of rigid die-cut laminated plastic modular cards having a plurality of sides. A first side of a first card has a plurality of cuts opposite and complementary to respective cuts of a first side of a second card, such that the cards may be assembled by interfacing sides in mating relation. The side of a card extends along an axis and is defined by a varying height profile formed by inner and outer lands, an outer land being along the outer edge of the side, and an inner land being recessed inwardly therefrom. The cards have a first assembled condition with coincident axes providing two-dimensional and three-dimensional structures. A slit in the side enables a third assembled condition with noncoincident axes.

16 Claims, 4 Drawing Sheets

MODULAR CARD CONSTRUCTION TOY

CROSS REFERENCE TO RELATED APPLICATION

This application is a continuation-in-part of U.S. application Ser. No. 08/863,856, filed May 27, 1997.

This application claims priority from Mexican Application No. 97358, filed Nov. 13, 1997.

BACKGROUND AND SUMMARY

The invention relates to construction toys, and more particularly to toys constructed of modular cards which may be assembled in a myriad of configurations. The invention is desirably suitable for low cost manufacture, including rigid laminated plastic cards which may be printed and die-cut, as opposed to more expensive injection molding.

In the field of construction toys, it is known to injection mold modular pieces of different shapes and sizes which may be assembled by a child in various manners to build various toy constructions. An objection is the expense of the injection molding.

The present invention arose from efforts to lower the manufacturing cost of the above noted type toys. In one aspect, the inventor provides a construction toy enabling usage of rigid die-cut laminated plastic modular cards, addressing and solving the above noted cost objection.

In another aspect, the invention enables numerous construction possibilities and combinations in two-dimensional structures, three-dimensional structures, static and dynamic structures, including a multitude of orientations and assembly angles.

DETAILED DESCRIPTION

Figure 1:
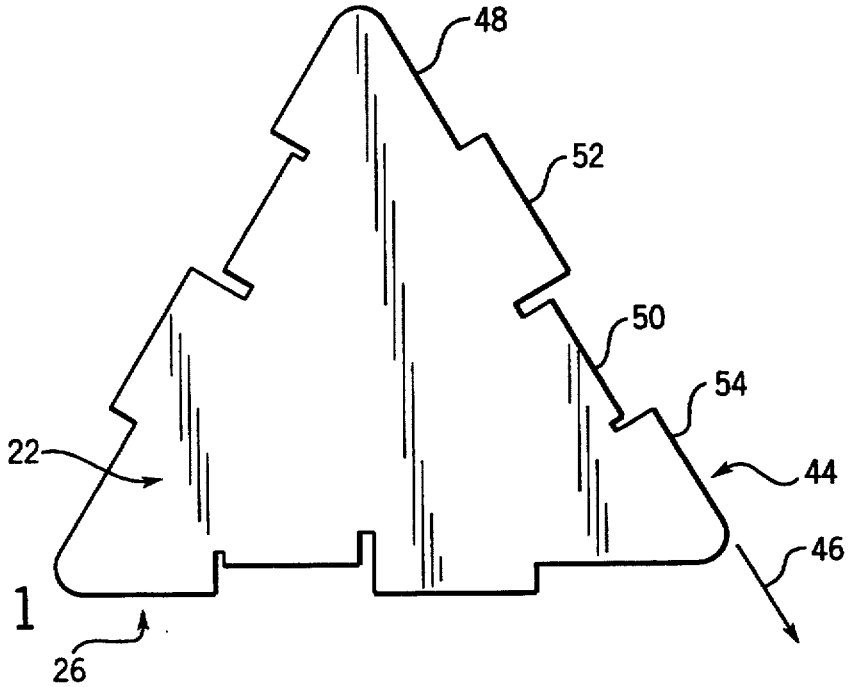
FIG. 1 is a top elevation view of a modular card constructed in accordance with the invention.
Figure 2:
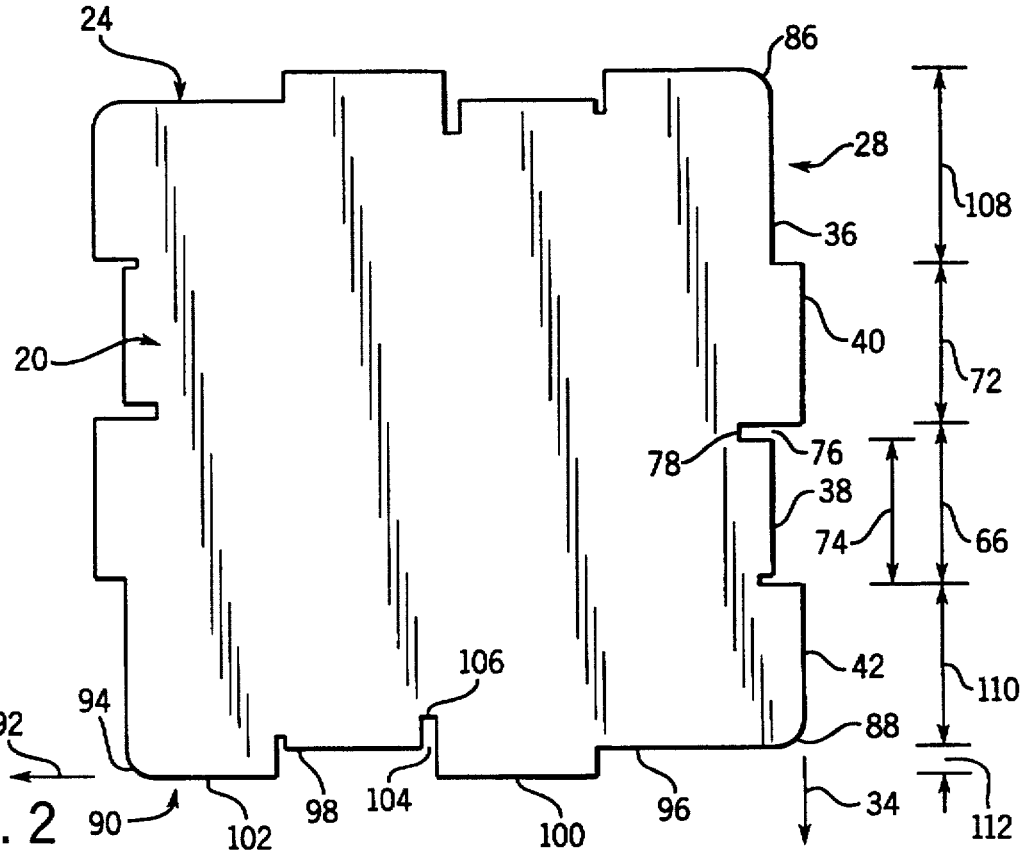
FIG. 2 is a top elevation view of another modular card constructed in accordance with the invention.

The drawings show a construction toy provided by a plurality of rigid die-cut laminated plastic modular cards each having a plurality of sides, for example card 20, FIG. 2, having four sides, and card 22, FIG. 1, having three sides. The cards are rigid, opaque, transparent or translucid laminated plastic of various shapes and sizes, and may be printed with graphics, lettering or the like. The cards are die-cut from a sheet in a perimeteral cut pattern generating modular cards allowing assembly and alignment at various angles, FIG. 2, as well as perpendicularly, FIG. 4, to build two dimensional and three dimensional structures.

Figure 3:
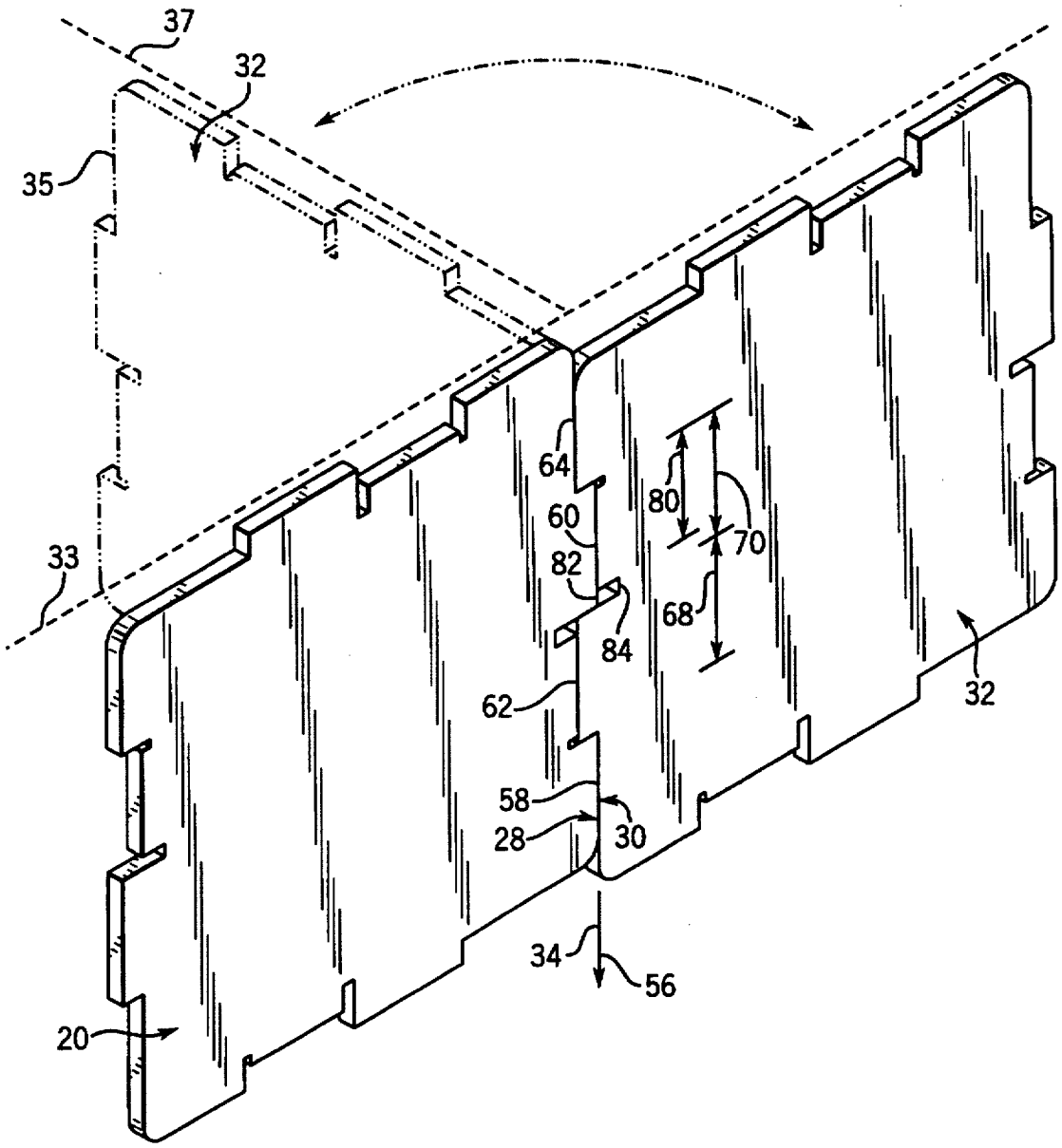
FIG. 3 is a perspective view showing cards in a first assembled condition.

Card 20 has a side 24 with a plurality of cuts opposite and complementary to respective cuts of a side 26 of card 22, such that cards 20 and 22 may be assembled by interfacing sides 24 and 26 in mating nested interlocking relation. This is also shown in FIG. 3 at side 28 of card 20 and side 30 of card 32. The sides of card 20 are identical to each other and to each of the sides of card 22 and to each of the sides of card 32. Side 28 of card 20, FIG. 2, extends along a first axis 34 and is defined by a varying height profile formed by inner lands 36, 38, and outer lands 40, 42. Outer lands 40, 42 are along the outer edge of side 28, and inner lands 36, 38 are recessed inwardly therefrom. Side 44 of card 22, FIG. 1, extends along an axis 46 and is defined by a varying height profile formed by inner lands 48, 50 and outer lands 52, 54. Outer lands 52, 54 are along the outer edge of side 44, and inner lands 48, 50 are recessed inwardly therefrom. Side 30 of card 32, FIG. 3, extends along axis 56 and is defined by a varying height profile formed by inner lands 58, 60 and outer lands 62, 64. Outer lands 62, 64 are along the outer edge of side 30, and inner lands 58, 60 are recessed inwardly therefrom.

Cards 20 and 32 have a first assembled condition as shown in solid line in FIG. 3, with axes 34 and 56 coincident, cards 20 and 32 coplanar along axis 33, outer lands 40, 42 of side 28 of card 20 facing and engaging inner lands 60, 58 of side 30 of card 32, and inner lands 36, 38 of side 28 of card 20 facing and engaging outer lands 64, 62 of side 30 of card 32. Cards 20 and 32 have a second assembled condition as shown in dashed line at 35 for card 32 in FIG. 3, with axes 34 and 56 coincident, and cards 20 and 32 lying in different planes along respective axes 33 and 37, and outer lands 40, 42 of side 28 of card 20 facing a different direction than inner lands 60, 58 of side 30 of card 32, and inner lands 36, 38 of side 28 of card 20 facing a different direction than outer lands 64, 62 of side 30 of card 32. Side 28 of card 20 is identical to side 30 of card 32, and such sides are oriented in mirror image relation in each of the assembled conditions shown in FIG. 3.

The distance 66, FIG. 2, along axis 34 between outer lands 40 and 42 of side 28 of card 20 is equal to the length 68, FIG. 3, along axis 56 of outer land 62 of side 30 of card 32. The distance 70 along axis 56 between outer lands 62 and 64 of side 30 of card 32 is equal to the length 72 along axis 34 of outer land 40 of side 28 of card 20. The length 74 along axis 34 of inner land 38 of side 28 of card 20 is less than the length 68 along axis 56 of outer land 62 of side 30 of card 32. A slit 76 is formed in side 28 of card 20 and extends inwardly from the outer edge thereof to a subland 78 recessed further inwardly than inner land 38. The length along axis 34 of subland 78 plus the length 74 of inner land 38 equals the length 68 along axis 56 of outer land 62 of side 30 of card 32. The length 80 along axis 56 of inner land 60 of side 30 of card 32 is less than the length 72 along axis 34 of outer land 40 of side 28 of card 20. A slit 82 is formed in side 30 of card 32 and extends inwardly from the outer edge thereof to a subland 84 recessed further inwardly than inner land 60 of side 30 of card 32. The length 80 along axis 56 of subland 84 of side 30 of card 32 plus the length 80 along axis 56 of inner land 60 of side 30 of card 32 equals the length 72 along axis 34 of outer land 40 of side 28 of card 20. Cards 20 and 32 have a third assembled condition, FIG. 4, with slits 76 and 82 engaging each other, and axes 34 and 56 noncoincident, preferably perpendicular to each other.

Card 20 has a plurality of identical sides extending along respective axes between respective corners. Side 28 extends along axis 34 from corner 86 to corner 88. Side 90 extends along axis 92 from corner 88 to corner 94. Side 90 is defined by a varying height profile including first and second inner lands 96, 98 and first and second outer lands 100, 102. Outer lands 100, 102 are along the outer edge of side 90, and inner lands 96, 98 are recessed inwardly therefrom. Inner land 36 of side 28 is at corner 86. Outer land 42 of side 28 is at corner 88. Inner land 96 of side 90 is at corner 88. Outer land 102 of side 90 is at corner 94. Side 90 has a slit 104 extending inwardly from the outer edge between outer land 100 and inner land 98 to a subland 106 recessed further inwardly than inner land 98. The length 108 of inner land 36 of side 28 along axis 34 between corner 86 and outer land 40 of side 28 is equal to the length 110 of outer land 42 of side 28 along axis 34 between inner land 38 of side 28 and corner 88 plus the height 112 of outer land 100 of side 90 along axis 34.

Figure 5:
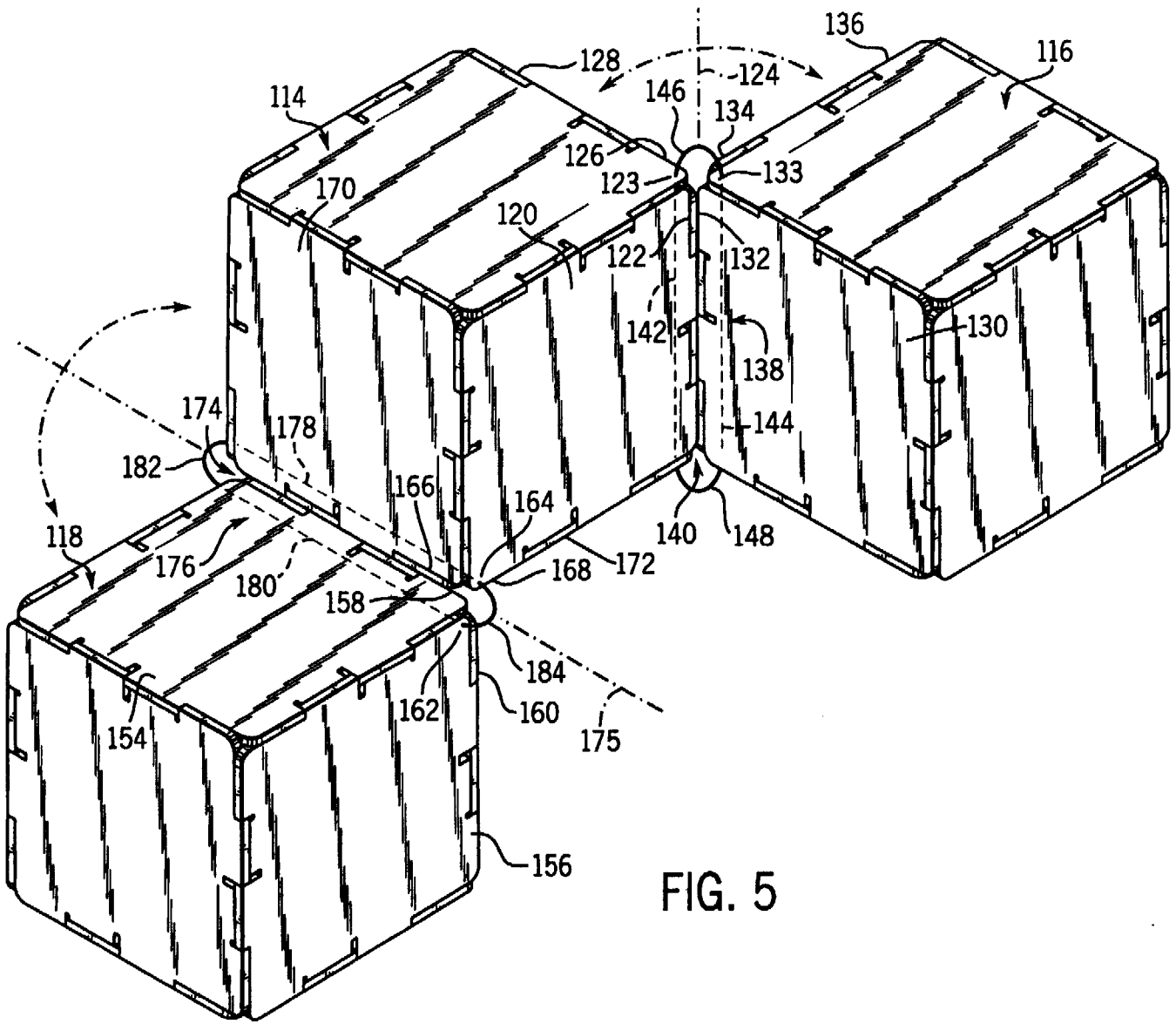
FIG. 5 is a perspective view showing a further assembled combination.

FIG. 5 shows a construction including a first set of six modular cards forming an enclosure 114 in the form of a cube, a second set of six modular cards forming an enclosure 116 in the form of a cube, and a third set of six modular cards forming an enclosure 118 in the form of a cube. Each of the eighteen modular cards of FIG. 5 is identical and is a square card as shown in FIG. 2. Cube enclosure 114 includes a first card 120 having a first side 122 extending along axis 124 and mated with side 126 of card 128 which also extends along axis 124. Cube enclosure 116 includes a first card 130 having a side 132 extending along axis 124 and mating with side 134 of card 136. The interface 123 of sides 122 and 126 of cards 120 and 128 faces the interface 133 of sides 132 and 134 of cards 130 and 136. A connector 138 holds the interface 123 of sides 126 and 122 of cards 120 and 128 against the interface 133 of sides 132 and 134 of cards 130 and 136 to form a joint 140 thereat along axis 124. The connector is a closed loop member encircling joint 140 and having a first leg 142 in the interior of enclosure 114 along the side of interface 123 opposite interface 133. Closed loop connector 138 has a second leg 144 in the interior of enclosure 116 along the side of interface 133 opposite interface 123. Closed loop connector 138 has ends 146 and 148 at the distally opposite ends of joint 140, and exterior to enclosures 114 and 116. In preferred form, connector 138 is a rubber band. The six modular cards of cube enclosure 118 include cards 154 and 156 assembled at respective sides 158 and 160 in mating relation forming an interface 162 coincident with interface 164 formed by sides 166 and 168 of cards 170 and 172 of enclosure 114 along a joint 174 along axis 175 and different than joint 140 and axis 124. A second closed loop rubber band connector 176 connects enclosures 114 and 118 at joint 174. Connector 176 has a first inner leg 178 interior to enclosure 114, a second leg 180 interior to enclosure 118, and ends 182 and 184 at distally opposite ends of joint 174 exterior to enclosures 114 and 118.

Figure 4:
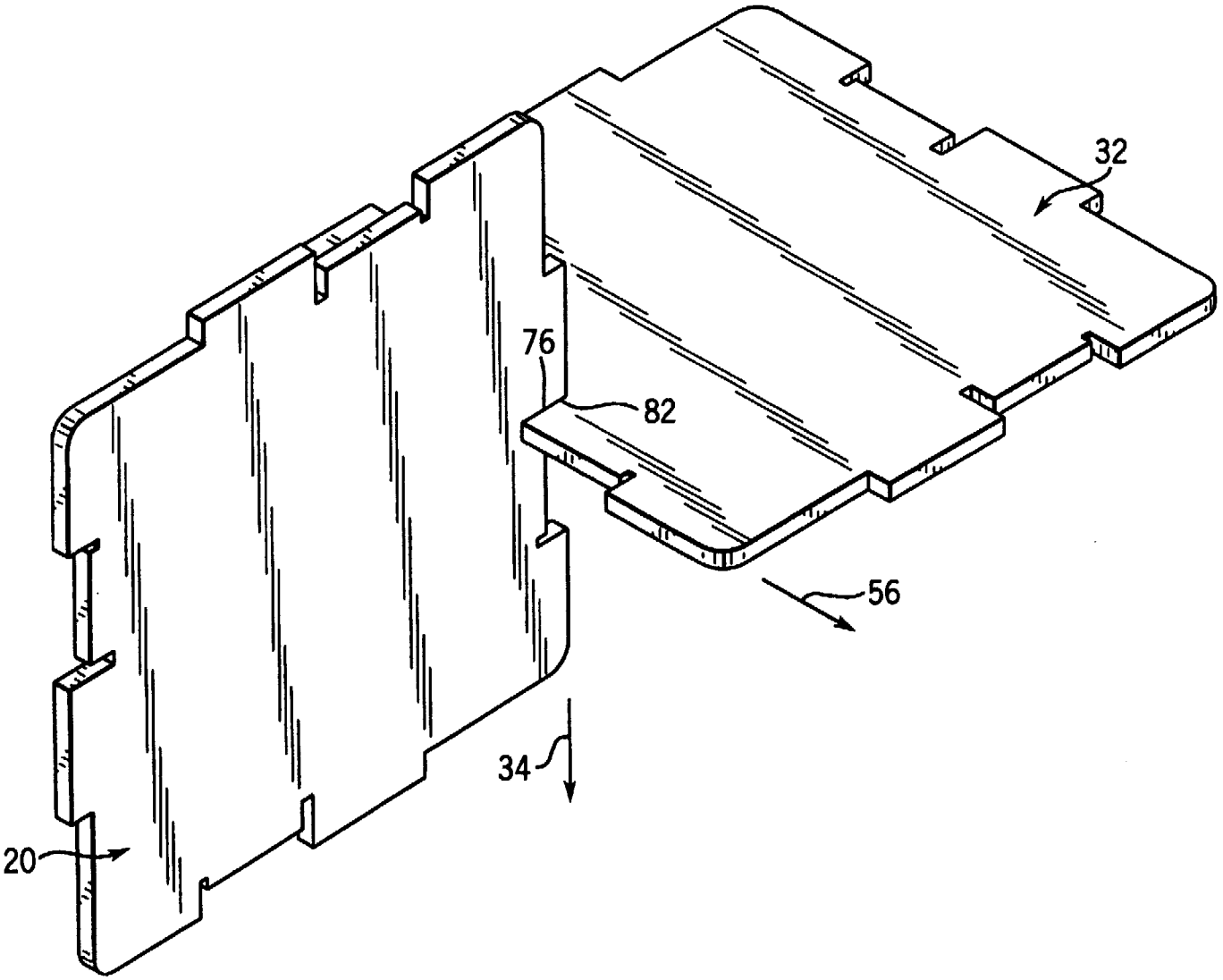
FIG. 4 is a perspective view showing cards in a second assembled condition.

As noted in priority Mexican patent application No. 97358, filed Nov. 13, 1997, which is recited hereinbelow, a construction toy is achieved through rigid modular cards printed on opaque, transparent or translucid laminated plastic of various shapes and sizes, which integrates a perimeteral cut which allows the modules to be assembled and aligned and at any angle, as well as perpendicularly, to create unlimited two-dimensional and three-dimensional structures, and with the use of a rubber band or cord that passes through the interior of the joints, allowing creation of folding axes with unlimited possibilities in the construction of dynamic three-dimensional structures. The invention relates to a new construction toy for children achieved through rigid modular cards of different shapes and sizes, printed and die-cut on rigid opaque, transparent or translucid laminated plastic, which integrates a particular design of perimeteral cut which permits it's assembly aligned at any angle, even perpendicular, to create unlimited two-dimensional and three-dimensional, static and dynamic structures. In the field of toy construction systems, there are those known up to now made from injection molding that generate modular pieces of different shapes and sizes with different assembly systems, none of which offers the possibility of multiple assembly positions on each of the joints. Another inconvenience that these construction systems present is that the injection molding process is expensive in comparison to the die-cut system of laminated plastics, which offers the advantage of being printed at a low cost which results in extremely inexpensive modular pieces either by silk-screen printing or printed stickers. The toy construction system of the invention resolves the noted problem, besides offering the possibility of assembly aligned at any angle including perpendicular, to form unlimited two and three-dimensional, static and dynamic structures. For this reason it focuses it's characteristics on a model of various shapes and sizes, printed and die-cut on rigid opaque, transparent or translucid laminated plastic, which integrate a new perimeteral cut which allows the modules to be assembled and aligned at any angle as well as perpendicularly, various other features, objects and advantages of the invention will be made apparent from the following drawings and detailed description. FIG. 1 shows two of the principal modules where the special perimeteral cut is shown. FIG. 2 shows the aligned assembly uniting at any angle. FIG. 3 shows the perpendicular assembly. FIG. 4 shows how to transform the three-dimensional static structures into dynamic structures. In FIG. 1 two principle modules which integrate the special perimeteral cut which allows them to be assembled and aligned by the sides, comprised of opposite and complementary cuts. In FIG. 2 it can be observed that these cuts allow the modules to be held by their sides in various positions, forming a two-dimensional plane or a three-dimensional object holding at any angle. In FIG. 1, the special cut also has a slit that permits it's perpendicular assembly, FIG. 3. In FIG. 4 once some three-dimensional structures are built, a rubber band or cord passes through the interior of the joints to create folding axises for an unlimited amount of possible constructions of dynamic three-dimensional structures. A construction toy is achieved through rigid modular cards of various shapes and sizes, printed and die-cut on rigid opaque, transparent or translucid laminated plastic, with a special perimeteral cut composed of opposite and complementary cuts which allow them to be assembled and held aligned by their sides, two-dimensional, and at any angle, three-dimensional. A construction toy is achieved through rigid modular cards of various shapes and sizes, printed and die-cut on rigid laminated plastic with a special perimeteral cut such as is noted above, integrating a slit in the center of it's sides which create it's perpendicular assembly. A construction toy is achieved through rigid modular cards of various shapes and sizes printed and die-cut on laminated plastic with a special perimeteral cut such as is described above, where the three-dimensional structures are formed, and a rubber band or cord passes through the interior of the joints, allowing creation of folding axes, which offer unlimited possibilities for the construction of dynamic three-dimensional structures.

It is recognized that various equivalents, alternatives and modifications are possible within the scope of the appended claims.

I claim:

1. A construction toy comprising a plurality of rigid die-cut laminated plastic modular cards each having a plurality of sides, a first side of a first card comprising a plurality of cuts opposite and complementary to respective cuts of a first side of a second card, such that said first and second cards may be assembled by interfacing said sides in mating nested interlocking relation, wherein:

said first side of said first card extends along a first axis and is defined by a varying height profile formed by inner and outer lands, an outer land being along the outer edge of the side, and an inner land being recessed inwardly therefrom, and wherein said first side of said second card extends along a second axis and is defined by a varying height profile formed by inner and outer lands, an outer land being along the outer edge of the side, and an inner land being recessed inwardly therefrom;

said first and second cards have a first assembled condition with said first and second axes coincident, and said cards being coplanar, and an outer land of said first side of said first card facing an inner land of said first side of said second card, and an inner land of said first side of said first card facing an outer land of said first side of said second card, and wherein said first and second cards have a second assembled condition with said first and second axes coincident, and said first and second cards lying in different planes, and an outer land of said first side of said first card facing a different direction than an inner land of said first side of said second card, and an inner land of said first side of said first card facing a different direction than an outer land of said first side of said second card;

said first side of said first card comprises first and second outer lands and first and second inner lands, said first side of said second card comprises first and second outer lands and first and second inner lands, and wherein the distance along said first axis between said first and second outer lands of said first side of said first card is equal to the length along said second axis of said first outer land of said first side of said second card, and wherein the distance along said second axis between said first and second outer lands of said first side of said second card is equal to the length along said first axis of said first outer land of said first side of said first card; and the length along said first axis of said second inner land of said first side of said first card is less than the length along said second axis of said first outer land of said first side of said second card, and comprising a slit formed in said first side of said first card and extending inwardly from the outer edge thereof to a subland recessed further inwardly than said second inner land, wherein the length along said first axis of said subland of said first side of said first card plus the length along said first axis of said second inner land of said first side of said first card equals the length along said second axis of said first outer land of said first side of said second card, and wherein the length along said second axis of said second inner land of said first side of said second card is less than the length along said first axis of said first outer land of said first side of said first card, and comprising a slit formed in said first side of said second card and extending inwardly from the outer edge thereof to a subland recessed further inwardly than said second inner land of said first side of said second card, and wherein the length along said second axis of said subland of said first side of said second card plus the length along said second axis of said second inner land of said first side of said second card equals the length along said first axis of said first outer land of said first side of said first card, and wherein said first and second cards have a third assembled condition with said slits engaging each other and said first and second axes perpendicular to each other.

2. A construction toy comprising a plurality of rigid die-cut laminated plastic modular cards each having a plurality of sides, a first side of a first card comprising a plurality of cuts opposite and complementary to respective cuts of a first side of a second card, such that said first and second cards may be assembled by interfacing said sides in mating nested interlocking relation, wherein:

said first side of said first card extends along a first axis and is defined by a varying height profile formed by inner and outer lands, an outer land being along the outer edge of the side, and an inner land being recessed inwardly therefrom, and wherein said first side of said second card extends along a second axis and is defined by a varying height profile formed by inner and outer lands, an outer land being along the outer edge of the side, and an inner land being recessed inwardly therefrom;

said first side of said first card has a slit formed therein between an outer land and an inner land and extending inwardly from the outer land to a subland recessed further inwardly than the inner land; and said first side of said second card has a slit formed therein between an outer land and an inner land and extending inwardly from the outer land to a subland recessed further inwardly than the inner land, and wherein said first and second cards have a third assembled condition with said slits engaging each other and said first and second axes noncoincident.

3. A construction toy comprising a plurality of rigid die-cut laminated plastic modular cards each having a plurality of sides, a first side of a first card comprising a plurality of cuts opposite and complementary to respective cuts of a first side of a second card, such that said first and second cards may be assembled by interfacing said sides in mating nested interlocking relation, wherein:

said first side of said first card extends along a first axis and is defined by a varying height profile formed by inner and outer lands, an outer land being along the outer edge of said side and an inner land being recessed inwardly therefrom;

said first side of said second card extends along a second axis and is defined by a varying height profile formed by inner and outer lands, an outer land being along the outer edge of said side and an inner land being recessed inwardly therefrom;

a first side of a third card extends along a third axis and is defined by a varying height profile formed by inner and outer lands, an outer being along the outer edge of the side and an inner land being recessed inwardly therefrom;

a first side of a fourth card extends along a fourth axis and is defined by a varying height profile formed by inner and outer lands, an outer land being along the outer edge of the side and an inner land being recessed inwardly therefrom;

said first, second, third, fourth cards having an assembled condition with said first and second axes coincident and said first sides of said first and second cards in said mating nested interlocking relation and with said third and fourth axes coincident with each other and said first sides of said third and fourth cards in mating nested interlocking relation, and with said first, second, third, fourth axes all coincident, with the interface of said first sides of said first and second cards facing the interface of said first sides of said third and fourth cards.

4. The construction toy according to claim 3 comprising a closed loop connector encircling said joint, said closed loop connector having a first leg extending along the side of said first interface opposite said second interface, a second leg extending along the side of said second interface opposite said first interface, and first and second ends connecting said sides and at distally opposite ends of said joint.

5. The construction toy according to claim 4 comprising a first enclosure formed by a first set of said cards assembled along respective sides in said mating nested interlocking relation, including said first sides of said first and second cards along said first interface, and a second enclosure formed by a plurality of said cards assembled along respective sides in said mating nested interlocking relation including said first sides of said third and fourth cards along said second interface, and wherein said first leg of said closed loop connector is interior to said first enclosure, said second leg of said closed loop connector is interior to said second enclosure, said ends of said closed loop connector are exterior to each of said first and second enclosures.

6. The construction toy according to claim 5 comprising a third enclosure formed by a third set of a plurality of said cards assembled at respective sides in said mating nested interlocking relation, wherein a respective pair of sides of said third enclosure form an interface coincident with an interface formed by a respective pair of sides of said first enclosure along a second joint different than said first joint, and comprising a second closed loop connector connecting said first and third enclosures at said second joint and including a first leg interior to said first enclosure, a second leg interior to said third enclosure, and ends at distally opposite ends of said second joint and exterior to said first and third enclosures.

7. The construction according to claim 6 wherein said second joint is perpendicular to said first joint.

8. A construction toy comprising:

a first modular card having a plurality of sides including a first side extending along a first axis and having a varying height profile formed by inner and outer lands, an outer land being along the outer edge of the side, and an inner land being recessed inwardly therefrom;

a second modular card having a plurality of sides including a first side extending along a second axis and having a varying height profile formed by inner and outer lands, an outer land being along the outer edge of the side, and an inner land being recessed inwardly therefrom;

said cards being assembled by interfacing said sides in mating relation, wherein said first side of said first card has a slit formed therein between an outer land and an inner land and extending inwardly from the outer land to a subland recessed further inwardly than the inner land;

said first side of said second card has a slit formed therein between an outer land and an inner land and extending inwardly from the outer land to a subland recessed further inwardly than the inner land;

said first and second cards have an assembled condition with said slits engaging each other, and said first and second axes noncoincident.

9. The construction toy according to claim 8 wherein:

said first and second cards have a second assembled condition with said first and second axes coincident, said first and second cards coplanar, an outer land of said first side of said first card facing an inner land of said first side of said second card, an inner land of said first side of said first card facing an outer land of said first side of said second card;

said first and second cards have a second assembled condition with said first and second axes coincident, said first and second cards lying in different planes, an outer land of said first side of said first card facing a different direction than an inner land of said first side of said second card, an inner land of said first side of said first card facing a different direction than an outer land of said first side of said second card.

10. A construction toy comprising:

a first modular card having a plurality of sides including a first side extending along a first axis and having a varying height profile comprising first and second outer lands along the outer edge of the side and first and second inner lands recessed inwardly therefrom;

a second modular card having a plurality of sides including a first side extending along a second axis and having a varying height profile comprising first and second outer lands along the outer edge of the side and first and second inner lands recessed inwardly therefrom;

the distance along said first axis between said first and second outer lands of said first side of said first card being equal to the length along said second axis of said first outer land of said first side of said second card;

the distance along said second axis between said first and second outer lands of said first side of said second card being equal to the length along said first axis of said first outer land of said first side of said first card;

a slit formed in said first side of said first card and extending inwardly from the outer edge thereof to a subland recessed further inwardly than said second inner land of said first side of said first card;

a slit formed in said first side of said second card and extending inwardly from the outer edge thereof to a subland recessed further inwardly than said second inner land of said first side of said second card;

and wherein:

the length along said first axis of said second inner land of said first side of said first card is less than the length along said second axis of said first outer land of said first side of said second card;

the length along said first axis of said subland of said first side of said first card plus the length along said first axis of said second inner land of said first side of said first card equals the length along said second axis of said first outer land of said first side of said second card;

the length along said second axis of said second inner land of said first side of said second card is less than the length along said first axis of said first outer land of said first side of said first card;

the length along said second axis of said subland of said first side of said second card plus the length along said second axis of said second inner land of said first side of said second card equals the length along said first axis of said first outer land of said first side of said first card;

said first and second cards have an assembled condition with said slits engaging each other and said first and second axes perpendicular to each other.

11. The construction toy according to claim 10 wherein:

said first and second cards have a second assembled condition with said first and second axes coincident, said first and second cards coplanar, said first and second outer lands of said first side of said first card facing said first and second inner lands of said first side of said second card, said first and second inner lands of said first side of said first card facing said first and second outer lands of said first side of said second card;

said first and second cards have a third assembled condition with said first and second axes coincident, said first and second cards lying in different planes, said first and second outer lands of said first side of said first card facing a different direction than said first and second inner lands of said first side of said second card, said first and second inner lands of said first side of said first card facing a different direction than said first and second outer lands of said first side of said second card.

12. A construction toy comprising:

a first modular card having a plurality of sides including a first side extending along a first axis and having a varying height profile formed by inner and outer lands, an outer land being along the outer edge of the side, and an inner land being recessed inwardly therefrom;

a second modular card having a plurality of sides including a first side extending along a second axis and having a varying height profile formed by inner and outer lands, an outer land being along the outer edge of the side, and an inner land being recessed inwardly therefrom;

a third modular card having a plurality of sides including a first side extending along a third axis and having a varying height profile formed by inner and outer lands, an outer land being along the outer edge of the side, and an inner land being recessed inwardly therefrom;

a fourth modular card having a plurality of sides including a first side extending along a fourth axis and having a varying height profile formed by inner and outer lands, an outer land being along the outer edge of the side, and an inner land being recessed inwardly therefrom;

said first, second, third, fourth cards having an assembled condition with said first and second axes coincident and said first sides of said first and second cards in mating relation, and with said third and fourth axes coincident with each other, and said first sides of said third and fourth cards in mating relation, and with said first, second, third, fourth axes all coincident, with the interface of said first sides of said first and second cards facing the interface of said first sides of said third and fourth cards.

13. The construction toy according to claim 12 comprising a closed loop cord encircling said joint, said cord having a first leg extending along the side of said first interface opposite said second interface, a second leg extending along the side of said second interface opposite said first interface, and first and second ends connecting said legs and at distally opposite ends of said joint.

14. The construction toy according to claim 13 comprising:

a first enclosure formed by a first set of said cards assembled along respective sides in mating relation, including said first sides of said first and second cards along said first interface;

a second enclosure formed by a plurality of said cards assembled along respective sides in mating relation including said first sides of said third and fourth cards along said second interface;

and wherein:

said first leg of said cord is interior to said first enclosure;

said second leg of said cord is interior to said second enclosure;

said ends of said cord are exterior to each of said first and second enclosures.

15. The construction toy according to claim 14 comprising:

a third enclosure formed by a third set of a plurality of said cards assembled at respective sides in mating relation, a respective pair of sides of said third enclosure forming an interface coincident with an interface formed by a respective pair of sides of said first enclosure along a second joint different than said first joint;

a second connector cord connecting said first and third enclosures at said second joint, said second cord having a first leg interior to said first enclosure, a second leg interior to said third enclosure, and ends at distally opposite ends of said second joint and exterior to said first and third enclosures.

16. The construction toy according to claim 15 wherein said second joint is perpendicular to said first joint.

* * * * *